US006028579A

United States Patent [19]

Tsuboyama et al.

[11] Patent Number: 6,028,579

[45] Date of Patent: Feb. 22, 2000

[54] DRIVING METHOD FOR LIQUID CRYSTAL DEVICES

[75] Inventors: Akira Tsuboyama, Sagamihara; Kazunori Katakura, Atsugi; Jun Iba, Yokohama, all of Japan

[73] Assignee: Canon Kabushiki Kaisha, Tokyo, Japan

[21] Appl. No.: 08/871,375

[22] Filed: Jun. 9, 1997

[30] Foreign Application Priority Data

Jun. 12, 1996 [JP] Japan ..... 8-150985

[51] Int. Cl.[7] ..... G09G 3/36

[52] U.S. Cl. ..... 345/97; 345/94

[58] Field of Search ..... 345/87, 94, 95, 345/100, 97

[56] References Cited

U.S. PATENT DOCUMENTS

| | | | |
|---|---|---|---|
| 4,836,656 | 6/1989 | Mouri et al. | 350/350 S |
| 4,902,107 | 2/1990 | Tsuboyama et al. | 350/350 S |
| 5,033,822 | 7/1991 | Ooki et al. | 350/331 T |
| 5,041,821 | 8/1991 | Onitsuka et al. | 340/784 |
| 5,058,994 | 10/1991 | Mihara et al. | 359/56 |
| 5,267,065 | 11/1993 | Taniguchi et al. | 359/56 |
| 5,321,419 | 6/1994 | Katakura et al. | 345/97 |
| 5,469,281 | 11/1995 | Katakura et al. | 359/56 |
| 5,471,229 | 11/1995 | Okada et al. | 345/89 |
| 5,506,601 | 4/1996 | Mihara et al. | 345/103 |
| 5,519,411 | 5/1996 | Okada et al. | 345/89 |
| 5,521,727 | 5/1996 | Inaba et al. | 359/56 |
| 5,532,713 | 7/1996 | Okada et al. | 345/97 |
| 5,583,534 | 12/1996 | Katakura et al. | 345/97 |
| 5,592,190 | 1/1997 | Okada et al. | 345/89 |
| 5,592,191 | 1/1997 | Tsuboyama et al. | 345/97 |
| 5,598,229 | 1/1997 | Okada et al. | 348/792 |
| 5,602,562 | 2/1997 | Onitsuka et al. | 345/101 |
| 5,606,343 | 2/1997 | Tsuboyama et al. | 345/97 |
| 5,627,559 | 5/1997 | Tsuboyama et al. | 345/97 |
| 5,638,195 | 6/1997 | Katakura et al. | 349/143 |
| 5,646,755 | 7/1997 | Okada et al. | 345/97 |
| 5,657,038 | 8/1997 | Okada et al. | 345/94 |

FOREIGN PATENT DOCUMENTS

| | | |
|---|---|---|
| 0422904 | 4/1991 | European Pat. Off. . |
| 0606929 | 7/1994 | European Pat. Off. . |
| 63-118130 | 5/1988 | Japan . |

*Primary Examiner*—Matthew Luu
*Attorney, Agent, or Firm*—Fitzpatrick, Cella, Harper & Scinto

[57] ABSTRACT

A liquid crystal device of the type including a pair of substrates having thereon a group of scanning electrodes and a group of data electrodes, and a chiral smectic liquid crystal disposed between the substrates so as to form a pixel at each intersection of the scanning electrodes and the data electrodes, is driven by a driving method causing less crosstalk. The driving method includes the steps of sequentially applying a scanning selection signal to the scanning electrodes, and applying data signals to the data electrodes in synchronism with the scanning selection signal. The scanning selection signal includes a writing pulse having a pulse width ΔT for determining an optical state of the chiral smectic liquid crystal in cooperation with a data signal. Each data signal includes a data pulse for determining an optical state of the chiral smectic liquid crystal in cooperation with the writing pulse. A plurality of data signals are each designed to have a waveform determined based on a combination of data applied to pixels on at least two consecutively selected scanning electrodes. At least one of said plurality of data signals include an auxiliary pulse having a pulse width shorter than ΔT.

10 Claims, 13 Drawing Sheets

DRIVING METHOD FOR LIQUID CRYSTAL DEVICES

FIELD OF THE INVENTION AND RELATED ART

The present invention relates to a driving method or system for a liquid crystal device used in a display apparatus for a personal computer, a video camera, a navigation system, etc.

As technical subjects to be improved in a display apparatus using a liquid crystal device, there have been recognized a higher image quality and a lower power consumption.

For providing high-quality images, particularly in case of a simple matrix-type liquid crystal display, so-called "crosstalk", i.e., a contrast change on a display picture depending on the kind of the displayed picture, has been particularly problematic.

As for the power consumption, it has been required to minimize the power consumption for driving liquid crystal devices as a demand in view of a worldwide environmental problem and also a requirement in practical application for complying with portable computers.

The above-mentioned two problems depend remarkably on the liquid crystal drive waveform, and it has been considered difficult to simultaneously solve the two problems by using a conventional drive waveform.

Hereinbelow, some description will be made based on a prior art method with reference to drawings.

FIG. 1 shows a known set of drive waveforms. (In all the figures including FIG. 1, "1LS" represents one (scanning) line-selection period.) Referring to FIG. 1, each scanning selection signal comprises a clear(ing) phase and a write (or writing) phase so as to clear pixels on one line in advance in the clear phase and then write in the pixels on the one line in the write phase. In this example, data signals are simple bipolar data pulses.

Now, some explanation will be made regarding the influence of a drive waveform on an image quality when used for displaying a pattern on a display panel as will be described with reference to FIG. 2. The display panel is composed of scanning electrodes extending in a horizontal (X) direction and data electrodes extending in a vertical (Y) direction.

FIG. 2 illustrates a case wherein a picture including a pattern display region 2*a* displaying alternate black and white stripes appearing on every other scanning line as a central region on a white background. In the case of displaying such a picture, there results in a difference in brightness of "white"between a region 3*a* and a region 3*b*. This may be attributable to a difference in display signals between those applied at the column a region including the pattern display region 2*a* of alternate black and white stripes and those at the column b region only for providing the white background region during the scanning of the row 2 region.

More specifically, when the row 2 region in FIG. 2 is scanned, the column b region is supplied with continuation of ON-data signals (for displaying "white"), so that the data electrodes for the column b region are supplied with a continuation of data signals as shown in FIG. 3A. On the other hand, during the same period when the row 2 region in FIG. 2 is scanned, the data electrodes for the column a region are supplied with ON- and OFF-data signals alternately for displaying alternate black and white horizontal stripes appearing on every other scanning line in the pattern display region 2*a*, thus receiving a continuation of data signals as shown in FIG. 3B. As is understood from a comparison between FIGS. 3A and 3B, there is a frequency difference of two times so that during a period for scanning the row 2 region, there results of the liquid crystal in a difference in optical response at regions 3*a* and 3*b* both expected to display equally white states to provide a contrast difference between the regions 3*a* and 3*b*. In order to examine the phenomenon in further detail, FIGS. 4 and 5 are presented, which are schematic views of optical response curves C for ON-state pixels in response to data signal series 3A and 3B shown in FIG. 3A and FIG. 3B, respectively. A thin dot line drawn above each optical response curve C represents a light quantity (or transmittance) level under no voltage, and a linear solid line represents an average transmittance level of the response curve. As is understood from the comparison between curves C in FIGS. 4 and 5, average transmittance levels are 96% and 89% giving a substantial difference. In other words, a succession of data signals giving a lower frequency component (B) has resulted in a larger decrease in transmittance level in the ON state.

Such a phenomenon, i.e., one resulting in an optical state difference for pixels expected to display an identical optical state depending on a display pattern, is herein called "crosstalk".

As is understand from the above explanation, the "crosstalk" is principally caused by a frequency difference of drive signal waveform applied to a liquid crystal depending on a display pattern.

JP-A 63-118130 discloses a drive waveform wherein the influence of data signals on pixels at the time of non-selection is minimized by determining the data signal waveform by comparing consecutively applied two data. A characteristic portion of the drive waveform is illustrated in FIG. 6. The data signal waveform is characteristically designed, i.e., the data signal waveform is not only changed based on the ON/OFF data of a noted pixel but also modified depending on successively applied data signal. In other words, the data signal waveform is varied depending on whether consecutively applied data are different or the same. Also in the case of this waveform, a data signal waveform consecutively applied for displaying all white pixels as shown in FIG. 7A is different from a data signal waveform consecutively applied for displaying alternate white and black horizontal stripes as shown in FIG. 7B, giving a frequency which is a half that of FIG. 7A.

However, the waveform of FIG. 7B provides an effective voltage which is smaller than that of the waveform of FIG. 3B, thus causing a smaller crosstalk (luminance change due to a pattern) by data signals to provide a better picture quality as shown in FIG. 8 illustrating an optical response characteristic at C in response to the waveform of FIG. 7B reproduced at 7B. The crosstalk shown at C in FIG. 8 given by the data signal succession as shown in FIG. 7B is more suppressed than the crosstalk shown at C in FIG. 5 given by the data signal succession shown in FIG. 3B but is still larger than the crosstalk shown at C in FIG. 4 given by the data signal succession shown in FIG. 3A, thus showing that the set of data signal waveforms shown in FIG. 6 is still insufficient to suppress the crosstalk, thereby realizing high-picture quality as required on the market.

SUMMARY OF THE INVENTION

An object of the present invention is to provide a drive waveform for a liquid crystal device capable of better suppressing a crosstalk and realizing a high picture quality.

Another object of the present invention is to provide a drive waveform for a liquid crystal device capable of suppressing the power consumption.

According to the present invention, there is provided a driving method for a liquid crystal device of the type comprising a pair of substrates having thereon a group of scanning electrodes and a group of data electrodes, and a chiral smectic liquid crystal disposed between the substrates so as to form a pixel at each intersection of the scanning electrodes and the data electrodes, said driving method comprising:

sequentially applying a scanning selection signal to the scanning electrodes, and applying data signals to the data electrodes in synchronism with the scanning selection signal, wherein the scanning selection signal comprises a writing pulse having a pulse width ΔT for determining an optical state of the chiral smectic liquid crystal in cooperation with a data signal, each data signal comprises a data pulse for determining an optical state of the chiral smectic liquid crystal in cooperation with the writing pulse, a plurality of data signals are each designed to have a waveform determined based on a combination of data applied to pixels on at least two consecutively selected scanning electrodes, and at least one of said plurality of data signals include an auxiliary pulse having a pulse width shorter than ΔT.

In a preferred mode of the drive waveform according to the present invention, a data signal may be designed so that, even if it has a DC component within a period of selecting one line of scanning electrode (one-line selection period), the DC component is caused to approach zero (or substantially removed) during one frame period.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 9:
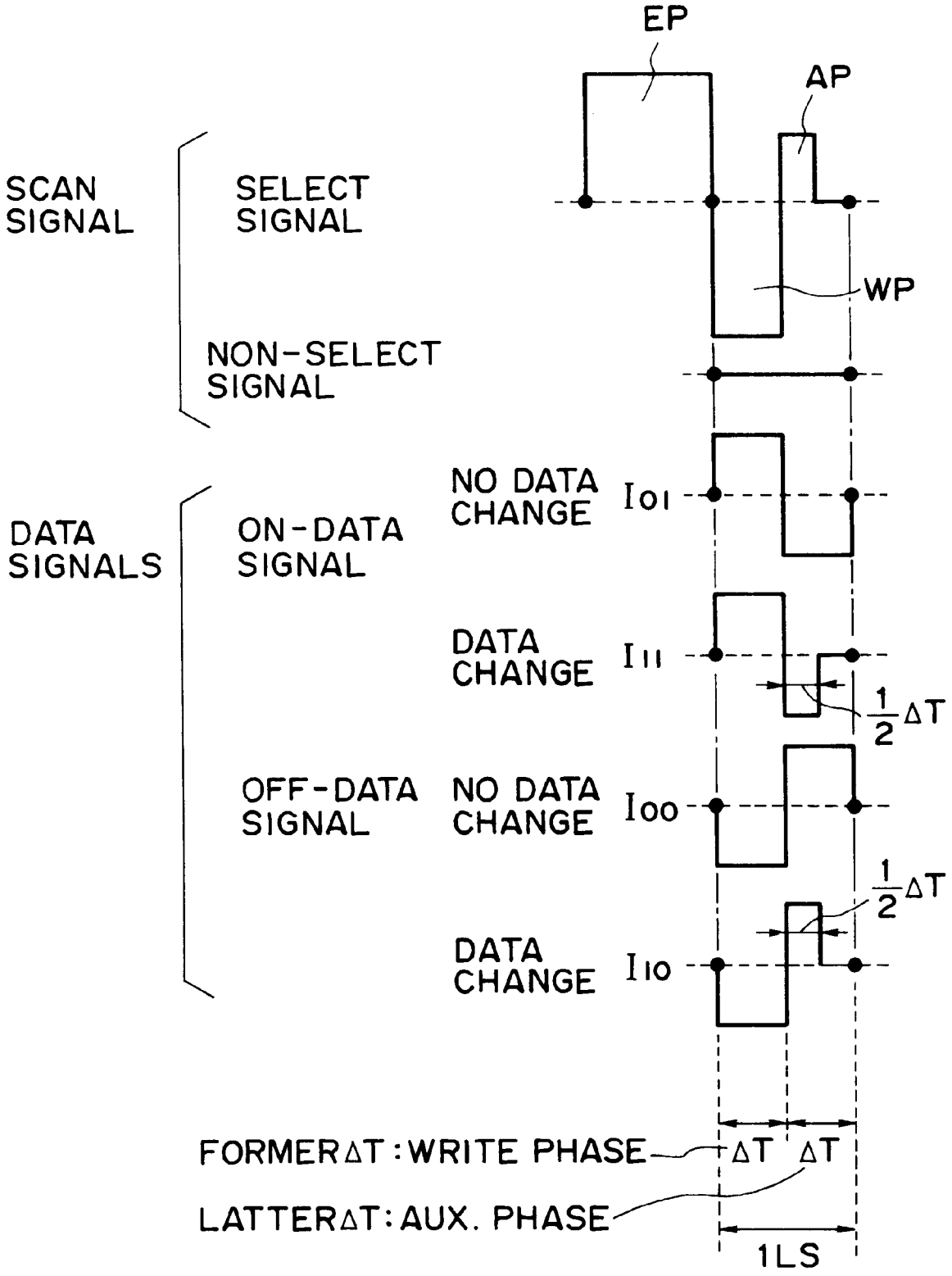
FIG. 9 shows a set of scanning signals and data signals according to an embodiment of the invention.

FIG. 9 is a waveform diagram showing a set of scanning signals and data signals suitably used in a preferred embodiment of the drive waveform for a liquid crystal device according to the present invention. More specifically, FIG. 9 shows two types of scanning signals (a scanning selection signal and a scanning non-selection signal) applied to the scanning electrodes and two types of ON/OFF data signals applied to the data electrodes. In this embodiment, the two types of data signals each include ON and OFF signals, so that FIG. 9 shows totally four data signals.

In case where ON-data is given to one pixel, a waveform $I_{01}$ or $I_{11}$ is selectively applied as an ON-data signal depending on whether the subsequent data is ON-data or OFF-data, respectively. In other words, the waveform $I_{01}$, is selected when consecutive two pixel data are both ON, and the waveform $I_{11}$ is selected when consecutive two pixel data are ON and OFF, respectively as an ON-data signal.

Similarly, in case where consecutive two pixel data are both OFF, a waveform $I_{00}$ is selected, and in case where consecutive two pixel data are OFF and OFF, a waveform $I_{10}$ is selected, respectively as an OFF-data signal. Referring to FIG. 9, each scanning signal and each data signal include a one-line selection period 1LS which is divided into a former half identified as a writing phase and a latter half identified as an auxiliary phase. In the auxiliary phase, a pulse having a polarity opposite to that of a DC voltage pulse applied in a preceding writing phase is applied. The waveforms $I_{11}$ and $I_{10}$ provide time-integrated voltages which are not completely zero in one-line selection period 1LS. Polarizers are set so that a positive voltage side will provide an OFF (black) state and a negative voltage side will provide an ON (white) state with respect to a scanning signal with reference to FIG. 9. More specifically, pixels on a selected scanning electrode are uniformly cleared (or reset or erased) into a black state corresponding to a first positive pulse of a scanning selection signal and then selectively written into optical states of liquid crystal determined depending on data signals applied in synchronism with a second negative pulse of the scanning selection signal. More specifically, the optical state at each pixel is determined depending on whether the black state formed by clearing is retained as it is or inverted into a white state.

Figure 10:
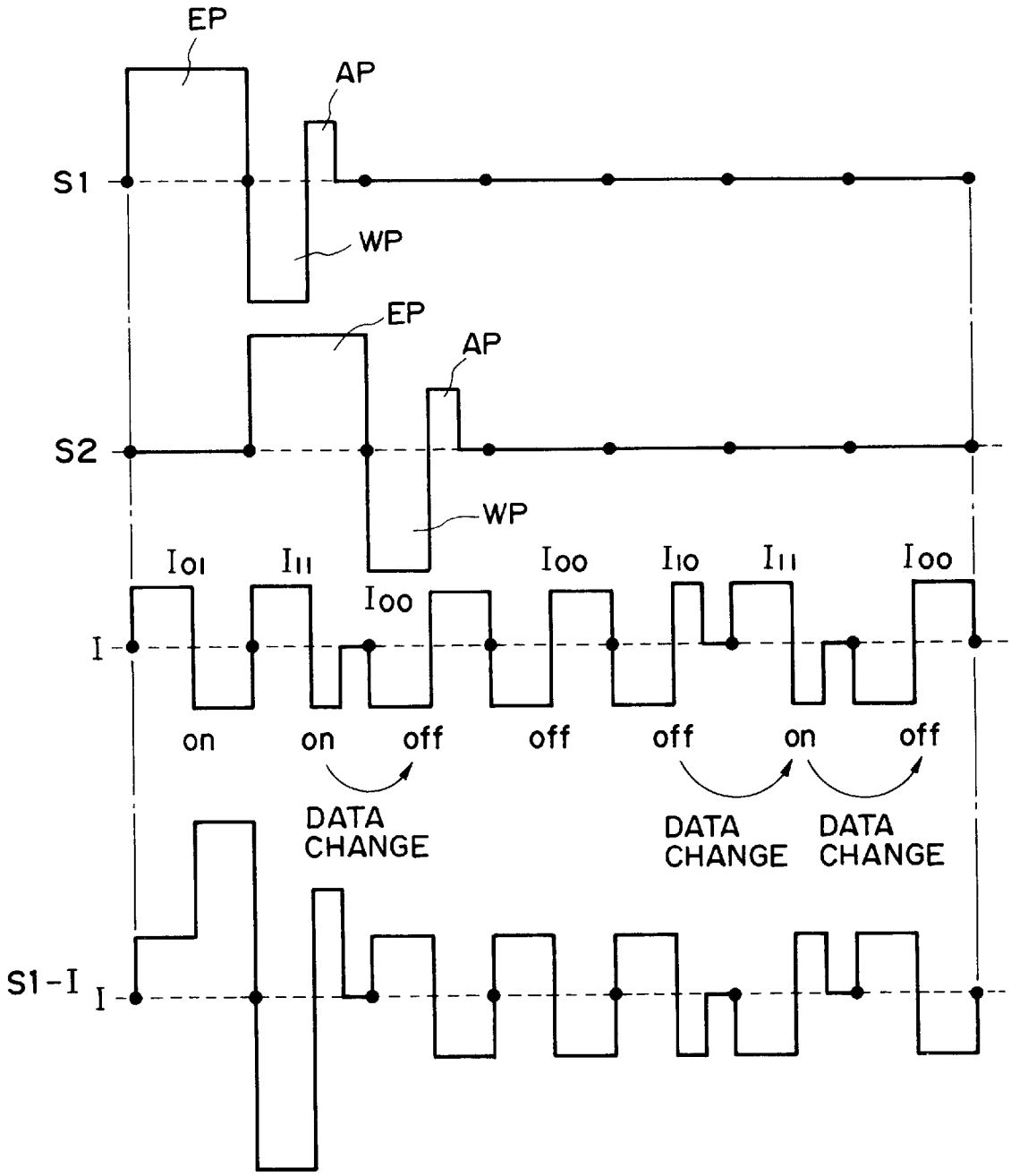
FIG. 10 shows an exemplary portion of succession of drive signals based on the embodiment of FIG. 9.

FIG. 10 shows a portion of time serial waveforms applied to a display panel when certain picture data (or pixel data) are applied to a data electrode I. When consecutively applied data include a change, i.e., ON→OFF or OFF→ON, the data signal $I_{11}$ or $I_{10}$ shown in FIG. 9 is applied. On the other hand, in case of no change, the data signal $I_{00}$ or $I_{01}$ , is applied. The data signals $I_{11}$ and $I_{10}$ retain a DC component corresponding to a period of $\Delta T/2$ within one-line selection period (1LS or also frequently denoted by "1H") but, as the changes of ON→OFF and OFF→ON occur frequently in pairs, the DC components are generally compensated for each other within a period longer than 1LS, e.g., one frame period. Accordingly, the DC components are not compensated within one-line selection period (12S or 1H) but may be compensated within a longer period because of the pair-occurring characteristic of $I_{11}$ and $I_{10}$ (in other words, one direction of data change cannot occur consecutively without intervening data change of the opposite direction). In the worst case where the data changes of ON→OFF and OFF→ON occur in an odd number of times, a DC component for a period of $\Delta T/2$ remains but, in view of a consecutive service time of a liquid crystal device, such a short period is short enough to regard the time-average DC component as substantially negligible.

If the set of drive signals shown in FIG. 9 is used, good pictures free from crosstalk can be displayed even in the case of displaying alternate lateral black and white stripes at a central region 2*a* on a white background as described with reference to FIG. 2. The reason therefor is briefly described below.

Figure 2:
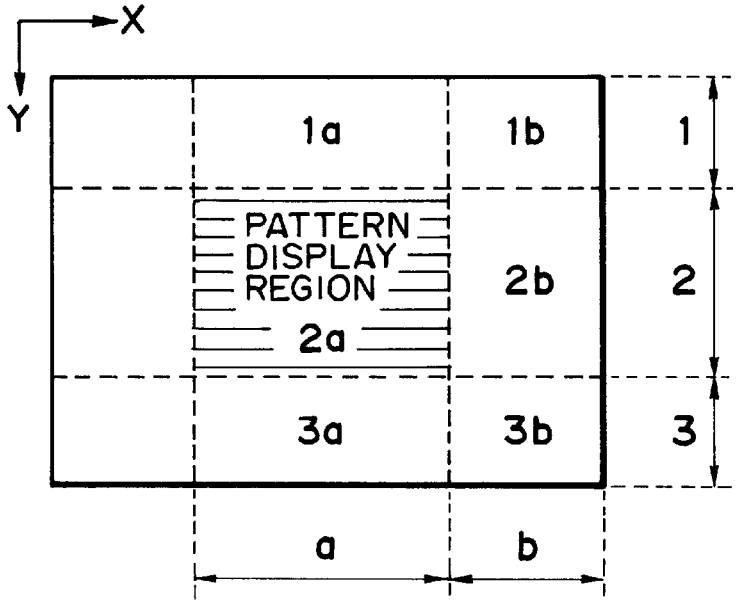
FIG. 2 illustrates an example of display pattern on a liquid crystal device.
Figure 3A:
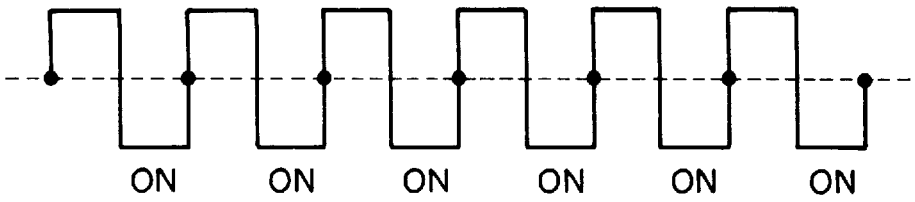
PRIOR ART FIG. 3A
FIGS. 3A and 3B show two types of successions of data signals given by the data signals shown in FIG. 1.
Figure 3B:
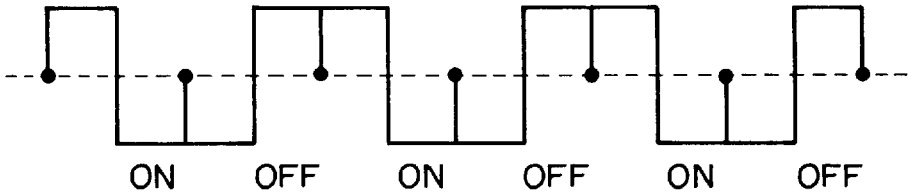
PRIOR ART FIG. 3B
Figure 8:
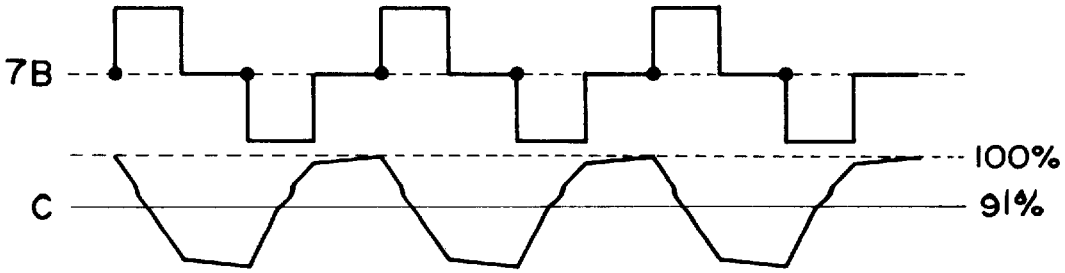
FIG. 8 illustrates an example of correlation between a succession of data signals and an optical response thereto.
Figure 11A:
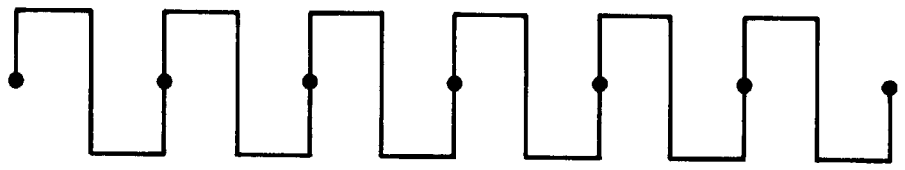
FIGS. 11A and 11B show two types of data successions given by the data signals shown in FIG. 9.
Figure 11B:
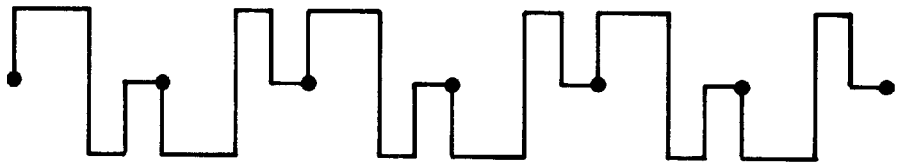
Figure 12:
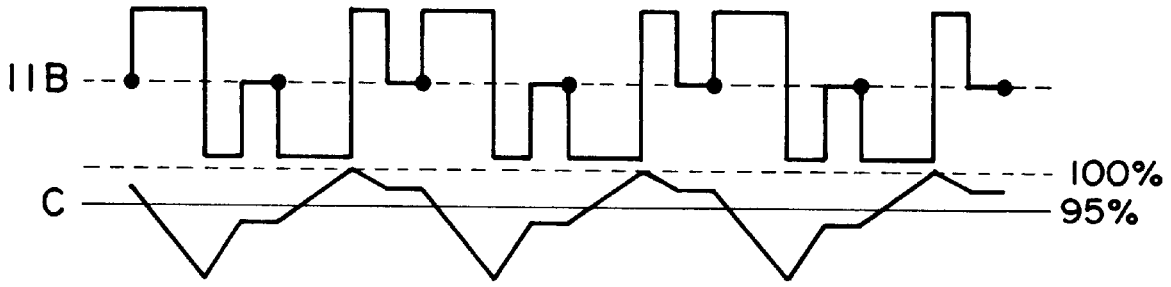
FIG. 12 illustrates an example of correlation between the succession of data signals (11B) shown in FIG. 11B and an optical response (C) thereto.

FIGS. 11A and 11B show two types of succession of the data signals shown in FIG. 9 applied to the data electrodes for the column a region and the column b region (identical to voltage signals applied to the pixels in the regions 3*a* and 3*b* placed in the non-selection period) when the row 2 region is scanned on the display panel shown in FIG. 2. FIG. 11A shows voltage signals applied to the pixels in the region 3*b*, and FIG. 11B shows voltage signals applied to the pixels in the region 3*a*, respectively, in FIG. 2. The optical response at the pixels in the region 3*b* receiving the waveform of FIG. 11A (identical to the waveform of FIG. 3A) is identical to the one shown at C in FIG. 4, and the optical response at the pixels in the region 3*a* receiving the waveform of FIG. 11B is shown at C in FIG. 12. Thus, the optical response at C in FIG. 12 is closer to the one shown at C in FIG. 4 than the one shown at C in FIG. 8 obtained by using the drive signals shown in FIG. 6 (optical response to the waveform shown in FIG. 17B). Thus, a remarkable crosstalk (picture quality deterioration due to a large difference in transmittance) can be prevented.

Figure 4:
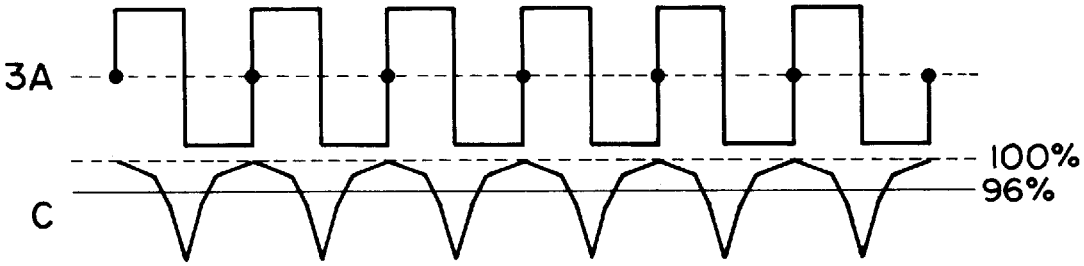
FIG. 4 illustrates an example of correlation between a succession of data signals and an optical response thereto.

Referring to FIG. 12, when the maximum transmittance represented by a dashed line is assumed to be 100%, the optical responses represented by the solid lines at C provide average transmittances of 96% in FIG. 4 and 95% in FIG. 12, so that it has been confirmed that the crosstalk can be suppressed to a level of practically no problem.

Figure 5:
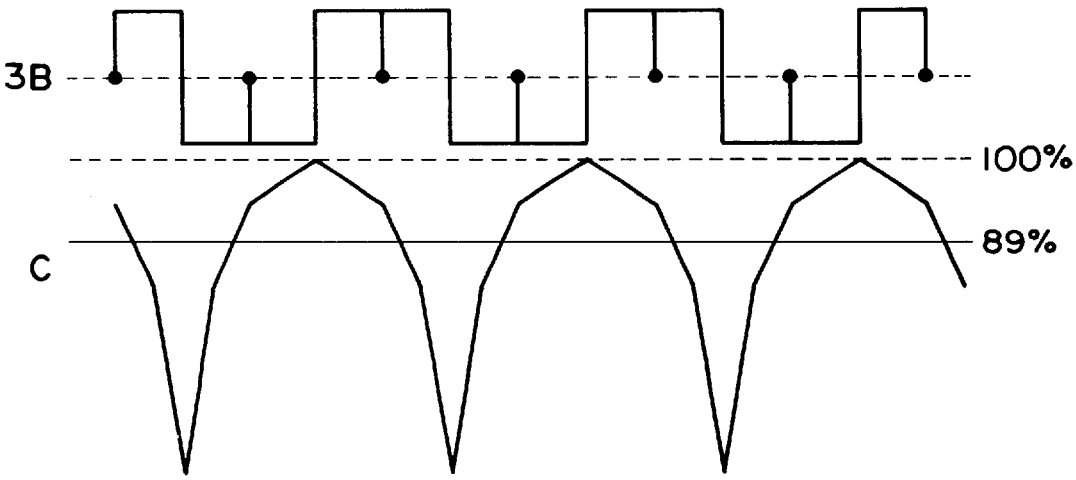
FIG. 5 illustrates another example of correlation between a succession of data signals and an optical response thereto.
Figure 6:
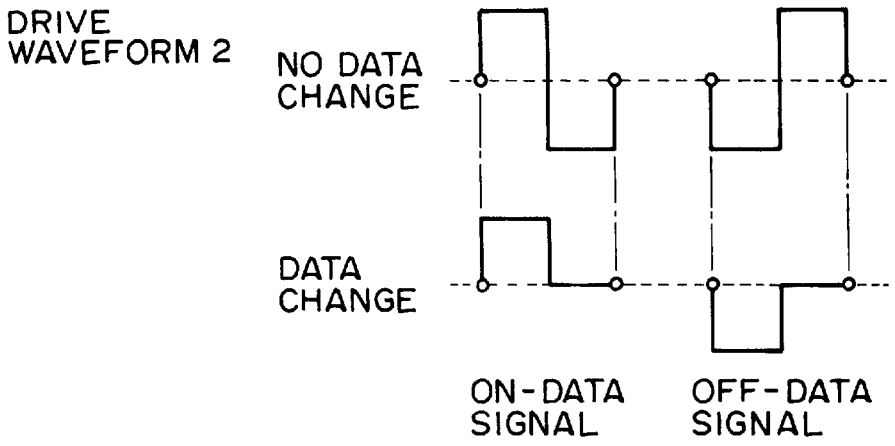
PRIOR ART FIG. 6
FIG. 6 shows two sets of known data signals selectively used depending on whether data change is present or not.
Figure 7A:
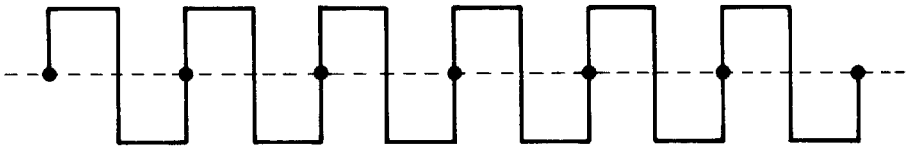
PRIOR ART FIG. 7A
FIGS. 7A and 7B show two types of successions of data signals given by the data signals shown in FIG. 6.
Figure 7B:
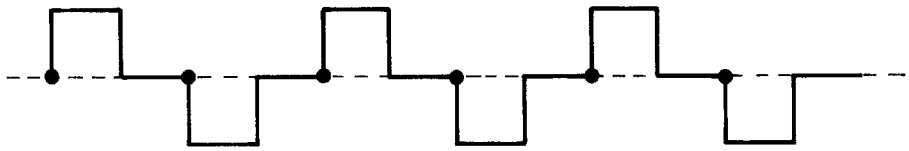
PRIOR ART FIG. 7B

The suppression of the crosstalk is accomplished by application of an opposite-polarity pulse of $\Delta T/2$ to suppress an optical perturbation as is understood from a comparison with the lower waveforms in FIG. 6 giving the optical response at C in FIG. 5 (which will be described as Comparative Example 1 hereinafter).

Further, in the case where pixels on two consecutively selected scanning electrodes receive different picture (or pixel) data, two consecutive data signals are not connected with pulses of an identical polarity as shown in FIG. 11B because the data signal $I_{11}$ and $I_{10}$ corresponding to the picture data have a period of no voltage. Thus, consecutive two data signals are always connected via a period of no voltage, thus suppressing a lowering in frequency of successively applied data signals.

On the other hand, in the case where pixels on two consecutively selected scanning electrodes receive identical picture data, data signals $I_{01}$, and $I_{00}$ having zero DC component are selected so that, even if data signals $I_{11}$ and $I_{10}$ retaining a DC component are alternately selected sometimes, the DC components can be regarded as being compensated with each other for a period sufficiently larger than one-line selection period (e.g., one frame period).

Incidentally, in the set of drive signals shown in FIG. 9, a clearing pulse EP and an auxiliary pulse AP in the scanning selection signal are pulses optionally used in connection with a selected scanning scheme and an adjustment of drive margin, and are not essential pulses used in the present invention.

Accordingly, the present invention is also applicable to any scheme, including a scheme as shown in FIG. 10 wherein a writing pulse WP is applied to a previously selected scanning electrode simultaneously with application of a clearing pulse EP to a subsequently selected scanning electrode; a scheme wherein a clearing pulse EP is simultaneously applied to all the scanning electrodes and then a writing pulse WP is sequentially applied to the respective scanning electrodes; and a scheme wherein each scanning electrode is first supplied with a clearing pulse and then, after an interval of one-line selection period or longer, sequentially supplied with a writing pulse.

Next, a drive circuit for generating the above-mentioned signals will be described.

Figure 13:
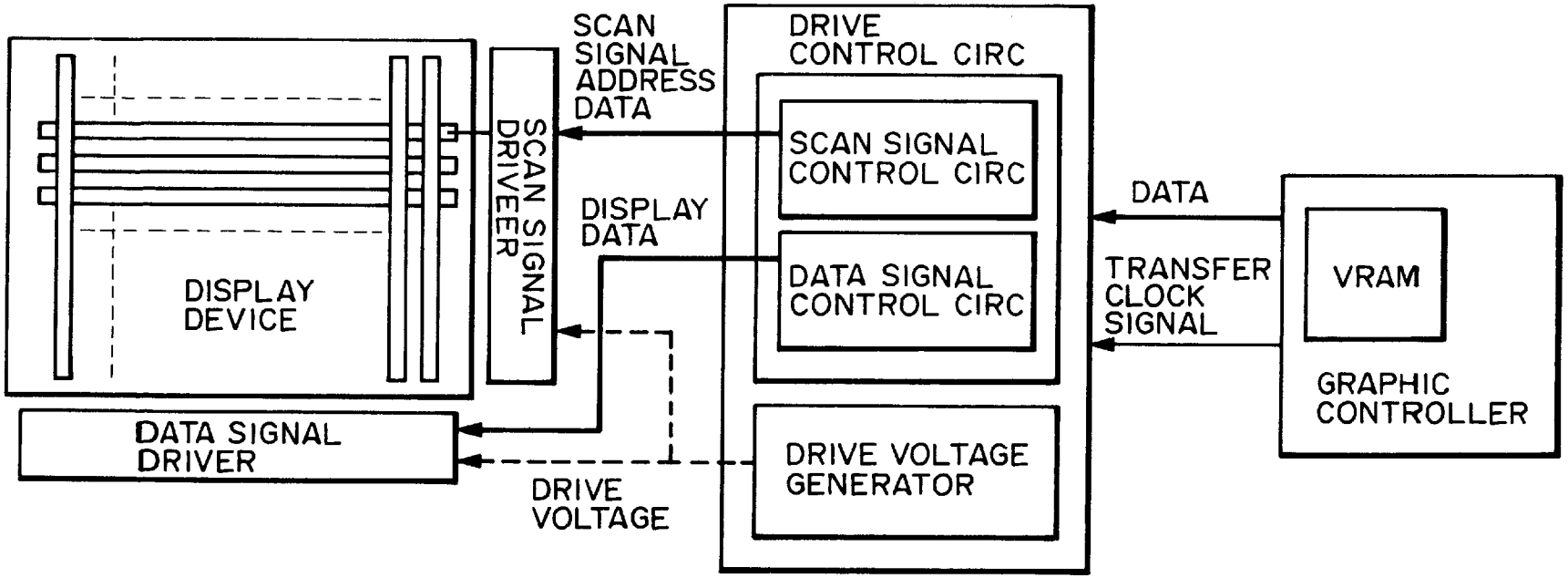
FIG. 13 is a block diagram of a liquid crystal apparatus including a liquid crystal device and a drive circuit therefor.

FIG. 13 is a block diagram of a liquid crystal display apparatus used for practicing the driving method according to the present invention.

Referring to FIG. 13, a graphic controller including a video RAM (VRAM) for memorizing picture data supplies data to a drive control circuit according to transfer clock signals. The data is inputted to a scanning signal control circuit and a data signal control circuit where the data is converted into address data and display data (picture data), respectively. Based on these data, scanning signal waveforms and data signal waveforms as shown in FIG. 9 are outputted from a scanning signal driver and a data signal driver. The data signal control circuit determines one data signal to be used among at least four data signals as shown in FIG. 9 depending on a combination of consecutively supplied pixel data and supplies the data signal to the data signal driver. More specifically, the drive signal control circuit includes a line memory for storing pixel data for pixels on one scanning electrode and compares the pixel data stored in the memory with pixel data for a subsequent line (of pixels on a subsequent scanning electrode) to evaluate whether consecutive two data are identical to each other for each data electrode.

A liquid crystal device used in the present invention may suitably comprise a liquid crystal panel comprising a chiral smectic liquid crystal disposed between a pair of substrates comprising a group of scanning electrodes and a group of data electrodes thereon.

Particularly, a ferroelectric chiral smectic liquid crystal showing a memory characteristic is suitably used in a simple matrix-type panel having a large number of scanning electrodes.

The scanning signal drive (IC) and the data signal driver (IC) may be disposed as shown in FIG. 9.

Figure 14A:
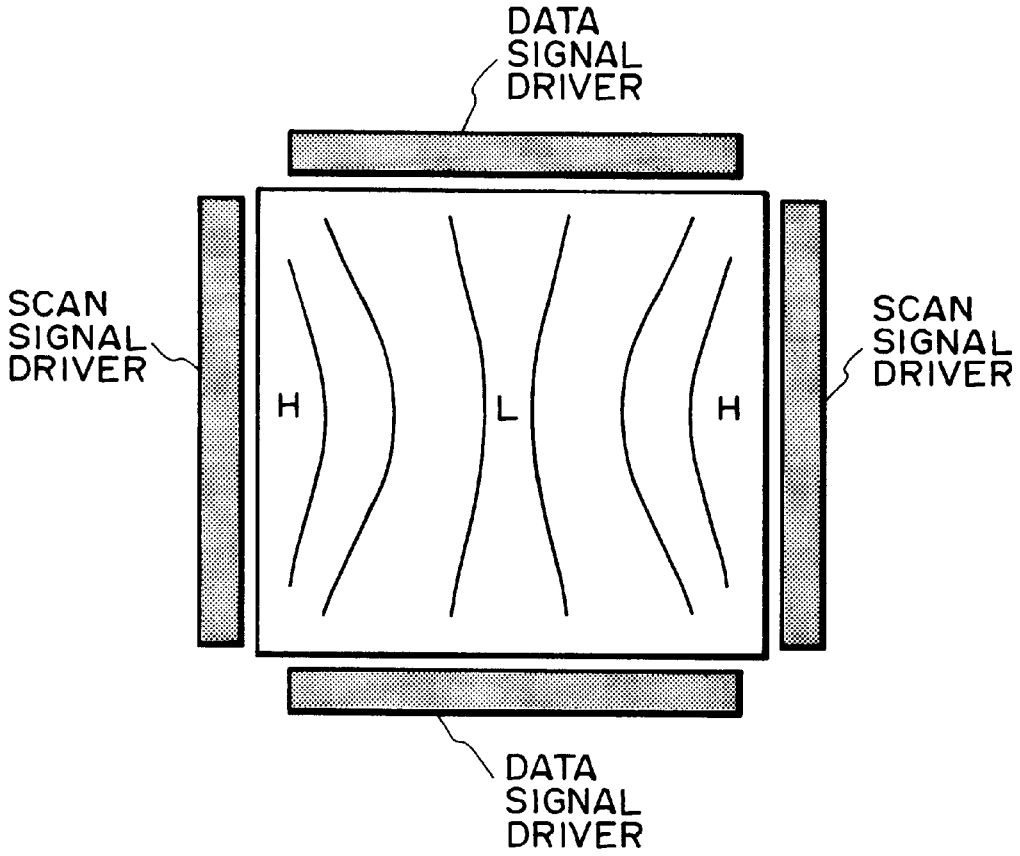
FIGS. 14A and 14B respectively illustrate a relationship between a liquid crystal device driver arrangement and a temperature distribution on the liquid crystal device (panel) for a liquid crystal device usable in the invention.
Figure 14B:
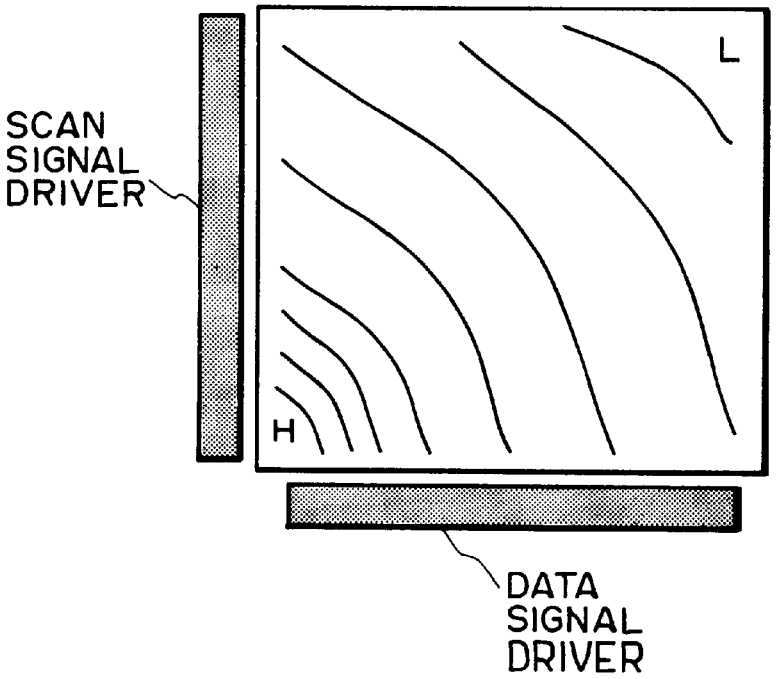

Particularly, the drivers may suitably be disposed along four sides of a liquid crystal panel. Scanning signal drivers may be disposed along left and right sides so that a driver for odd-numbered scanning electrodes is disposed along the left side and a driver for even-numbered scanning electrodes is disposed along the right side, and scanning signals are supplied alternately from the left side and from the right side. The same alternate side arrangement may be adopted for the data signal drivers. The four side arrangement is preferred (1) for allowing a lower density of arrangement of signal electrodes to provide an improved productivity, and (2) for providing a reduced temperature distribution on a liquid crystal panel to reduce a picture irregularity due to a temperature-dependent drive characteristic of the liquid crystal. FIGS. 14A and 14B show temperature distributions over liquid crystal panels in the cases of a two-side electrode arrangement and a four-side arrangement. It is believed clear from these figures that the Joule's heat evolved due to electrode resistances and heat evolution from the drivers are distributed to opposite sides, thus resulting in a reduced temperature distribution.

EXAMPLES

Example 1

A liquid crystal panel containing a liquid crystal composition characterized by the following properties was driven by applying the drive signals shown in FIG. 9.

Spontaneous polarization: 7 nC/cm$^2$ (30° C.)

Tilt angle: 15 deg.

Phase transition series and temperatures (° C.):

$$\text{Cryst.} \xleftrightarrow{-10} \text{SmC} \xleftrightarrow{65} \text{SmA} \xleftrightarrow{80} \text{Ch.} \xleftrightarrow{95} \text{Iso.}$$

The liquid crystal panel was a simple matrix-type panel comprising 1024×1280 display segments at a segment pitch of 230 $\mu$m and having an effective display region diagonal size of 14.8 inches. Each display segment comprised four (color) pixels of R, G, B and W and could provide totally 16 colors. The panel was driven under the conditions including a frame frequency of 15 Kz, a non-interlaced scanning scheme, and drive voltages including a scanning signal voltage of 30 volts (peak-to-peak) and a data signal voltage of 12 volts (peak-to-peak).

The pixels at regions 3*b* and 3*a* as in FIG. 2 resulted in optical responses shown at C in FIG. 4 and FIG. 12 when writing in every other alternate black and white lateral stripes at region 2*a* as described with reference to FIG. 2, whereby a good picture display was performed with good suppression of crosstalk.

Comparative Example 1

Figure 1:
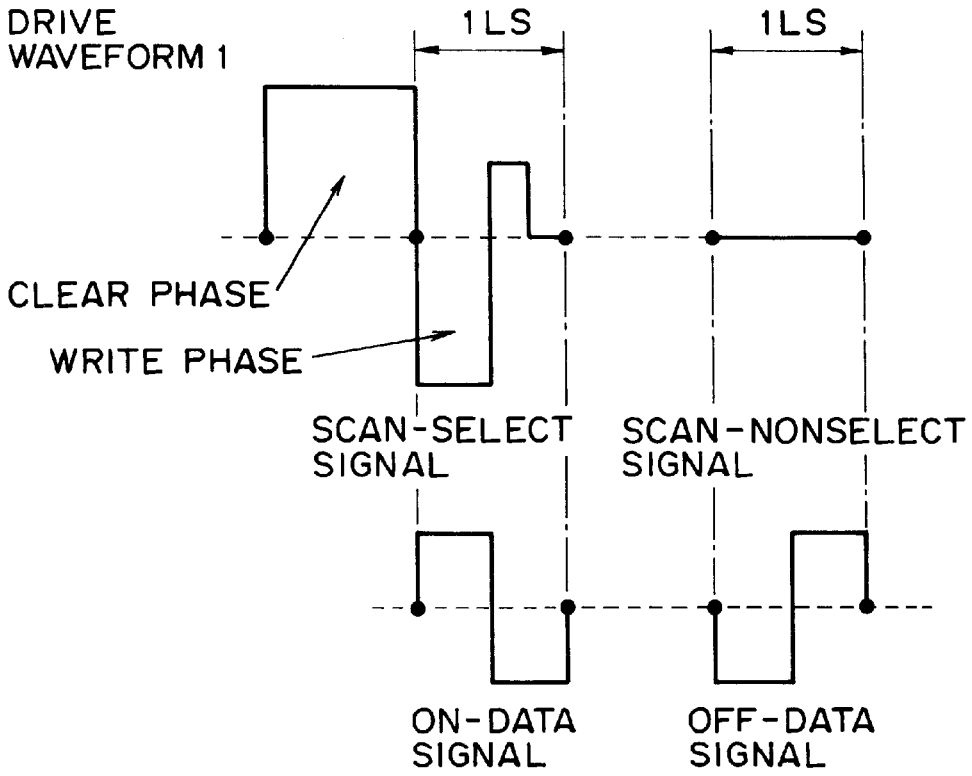
PRIOR ART FIG. 1
FIG. 1 is a diagram showing a known set of signal waveforms for driving a liquid crystal device.

An identical liquid crystal panel was driven by applying a set of drive signals shown in FIG. 1 otherwise in the same manner as in Example 1. As a result of drive for displaying every other alternate black and white lateral stripes at a central region 2*a* as described with reference to FIG. 2, the regions 3*a* and 3*b* provided remarkably different transmittances giving a ratio of 89:96 as shown at C in FIGS. 5 and 4.

Example 2

Figure 15B:
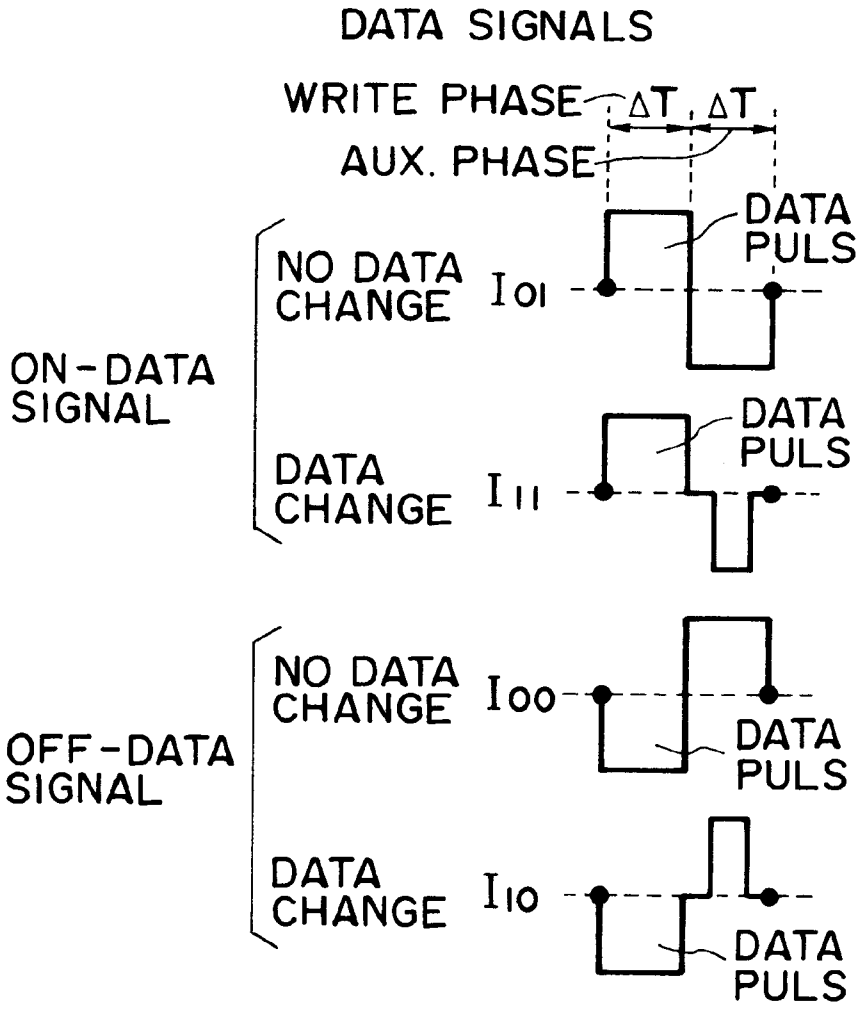
FIGS. 15A–15B, 16A–16B, 17A–17B and 18A–18B respectively illustrate a set of scanning signals and data signals according to another embodiment of the invention.
Figure 15A:
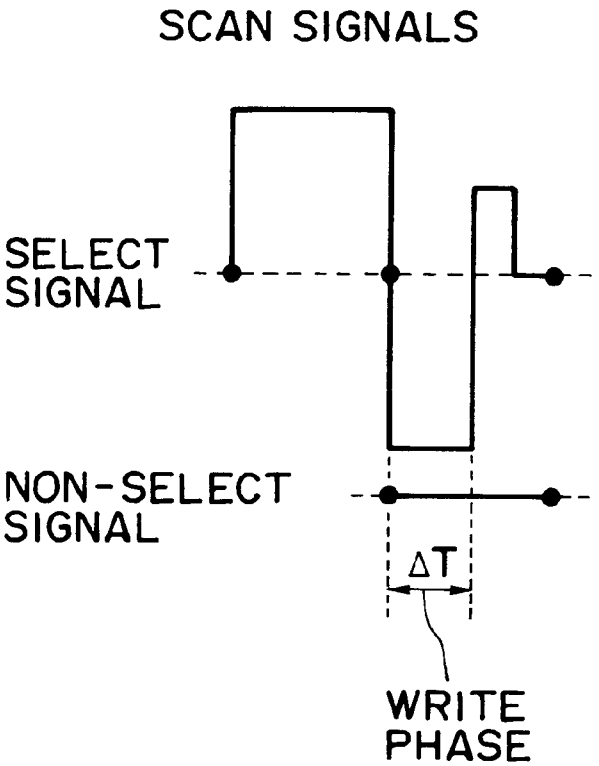

An identical liquid crystal panel was driven by applying a set of drive signals shown in FIGS. 15A and 15B otherwise in the same manner as in Example 1.

All four data signals include a data pulse synchronized with and having a pulse width ΔT identical to that of a writing pulse (ΔT) in a writing phase of a scanning selection signal. On the other hand, two data signals $I_{01}$ and $I_{00}$ applied in case of supplying consecutive two identical data included auxiliary pulses for DC compensation having pulse widths (ΔT) identical to that of the preceding data pulses, and two data signals $I_{11}$ and $I_{10}$ applied in case of supplying consecutive two different data included auxiliary pulses having pulse widths (ΔT/2) insufficient for DC compensation and sandwiched between periods each of ΔT/4 of no voltage.

As a result of drive for displaying every other alternate black and white lateral stripes at a central region 2*a* as described with reference to FIG. 2, the regions 3*a* and 3*b* provided substantially identical transmittances giving a ratio of 95:96, and a high quality picture of practically no problem was obtained.

Example 3

Figure 16B:
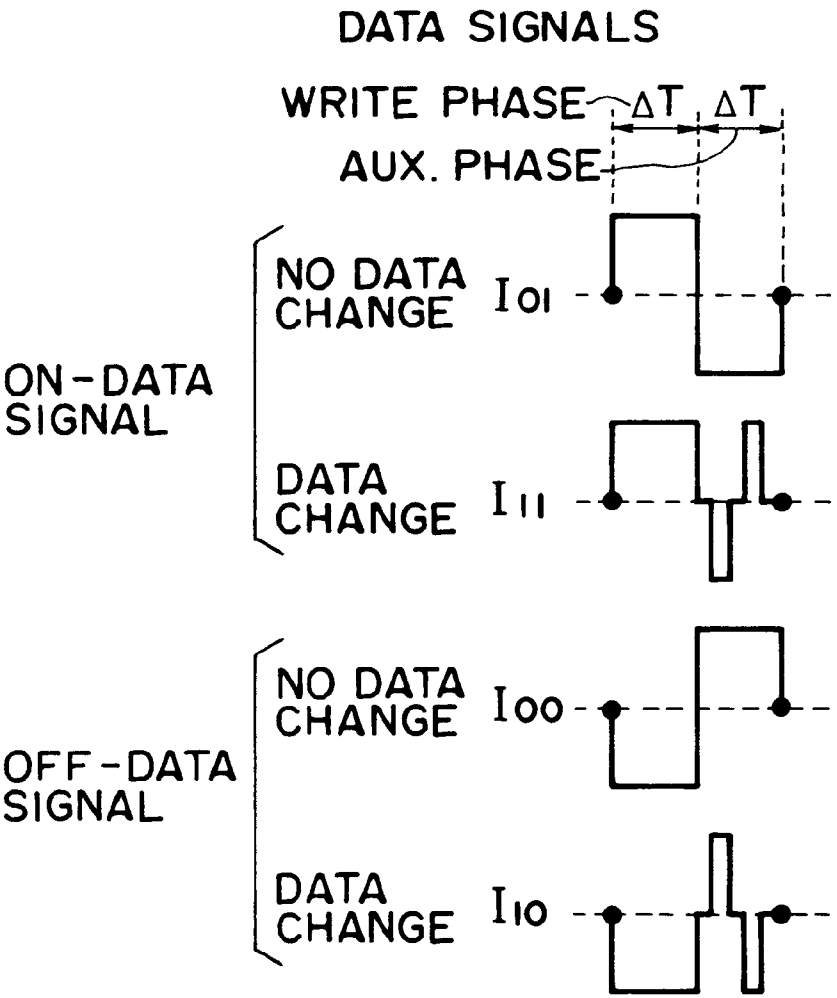
Figure 16A:
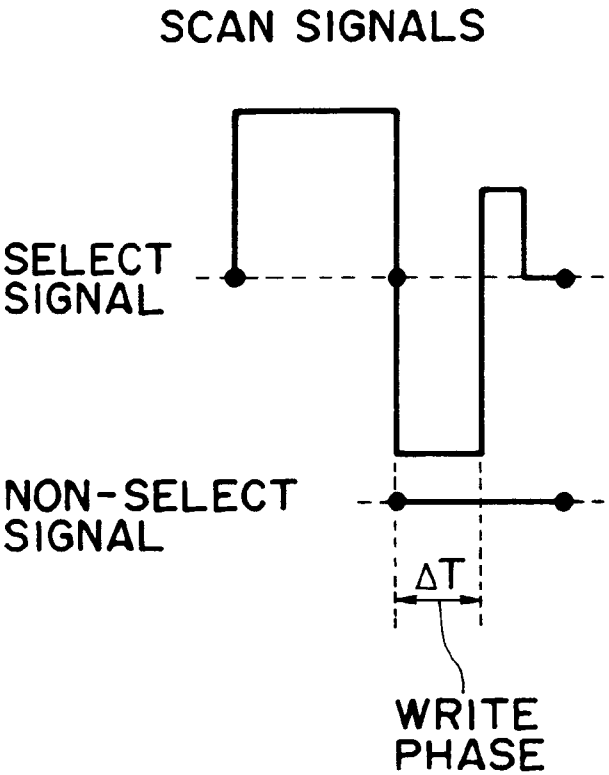

An identical liquid crystal panel was driven by applying a set of drive signals shown in FIGS. 16A and 16B otherwise in the same manner as in Example 1.

All four data signals include a data pulse synchronized with and having a pulse width ΔT identical to that of a writing pulse (ΔT) in a writing phase of a scanning selection signal. On the other hand, two data signals $I_{01}$ and $I_{00}$ applied in case of supplying consecutive two identical data included auxiliary pulses for DC compensation having pulse widths (ΔT) identical to that of the preceding data pulses, and each of two data signals $I_{11}$ and $I_{10}$ applied in case of supplying consecutive two different data included two auxiliary pulses of different polarities each having a pulse width (ΔT/4) not effective for DC compensation and sandwiching therebetween a period of ΔT/4 of no voltage.

As a result of drive for displaying every other alternate black and white lateral stripes at a central region 2*a* as described with reference to FIG. 2, the regions 3*a* and 3*b* provided substantially identical transmittances giving a ratio of 94:96, and a high quality picture of practically no problem was obtained.

Example 4

Figure 17B:
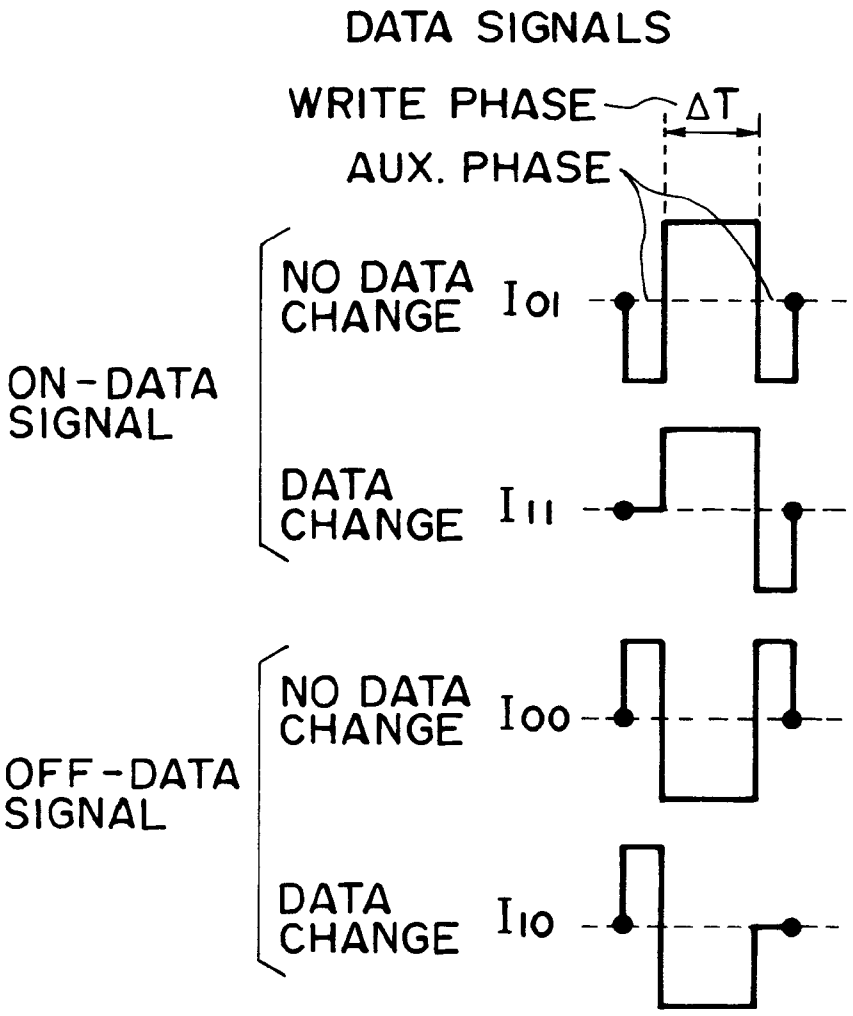
Figure 17A:
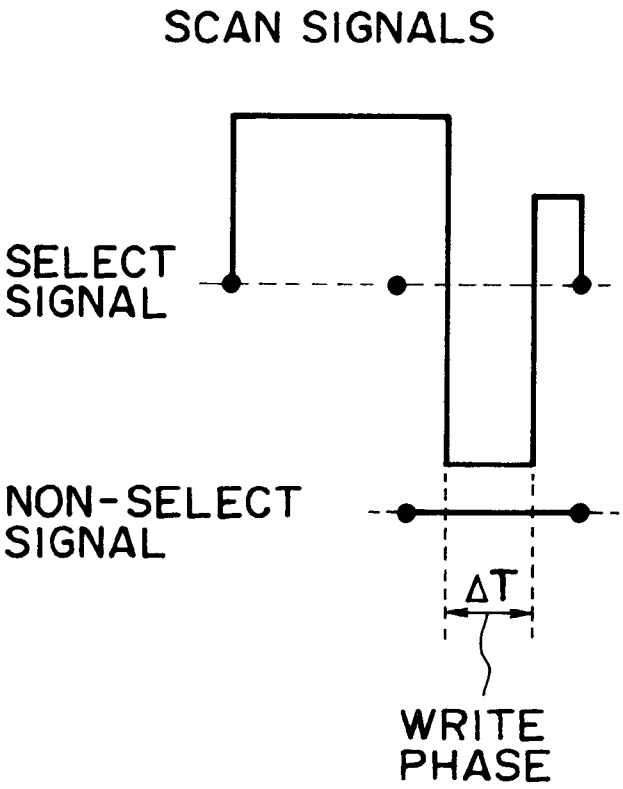

An identical liquid crystal panel was driven by applying a set of drive signals shown in FIGS. 17A and 17B otherwise in the same manner as in Example 1.

All four data signals include a data pulse synchronized with and having a pulse width ΔT identical to that of a writing pulse (ΔT) in a writing phase of a scanning selection signal. On the other hand, each of two data signals $I_{01}$ and $I_{00}$ applied in case of supplying consecutive two identical data included two auxiliary pulses for DC compensation each having a pulse width (ΔT/2) and sandwiching the data pulse, and each of two data signals $I_{11}$ and $I_{10}$ applied in case of supplying consecutive two different data included an auxiliary pulse having a pulse width (ΔT/2) insufficient for DC compensation placed after or before the data pulse.

As a result of drive for displaying every other alternate black and white lateral stripes at a central region 2*a* as described with reference to FIG. 2, the regions 3*a* and 3*b* provided substantially identical transmittances giving a ratio of 94:96, and a high quality picture of practically no problem was obtained.

Example 5

Figure 18B:
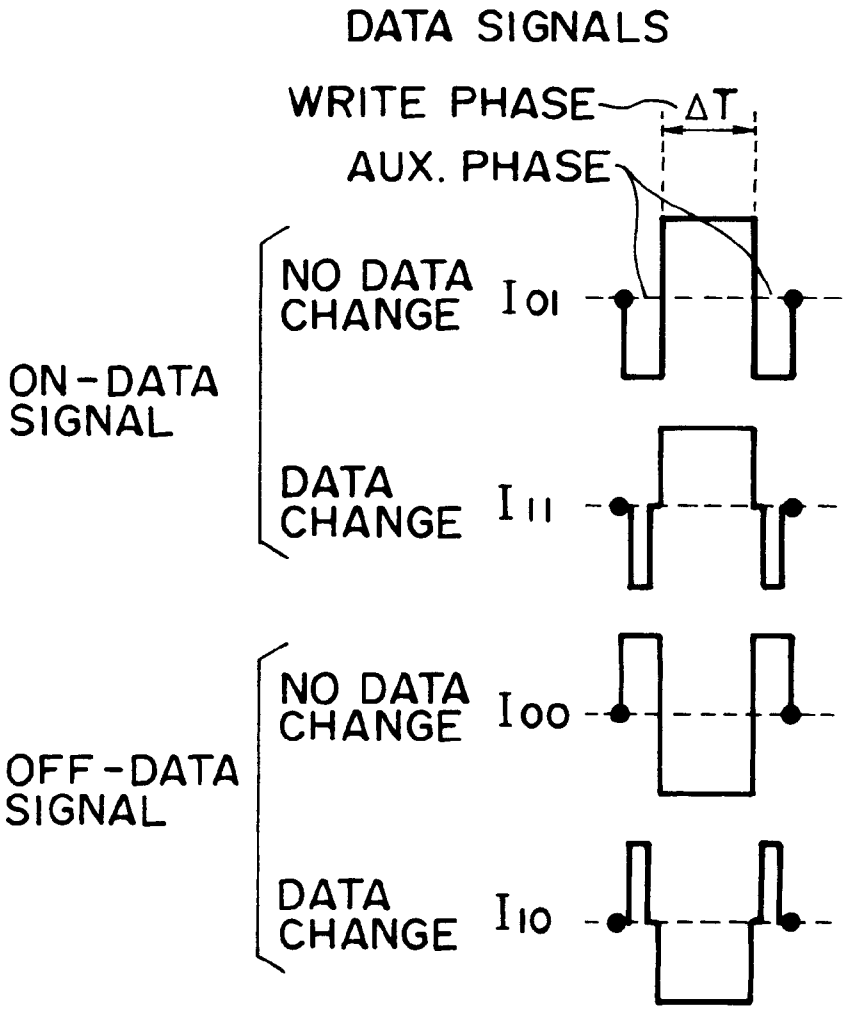
Figure 18A:
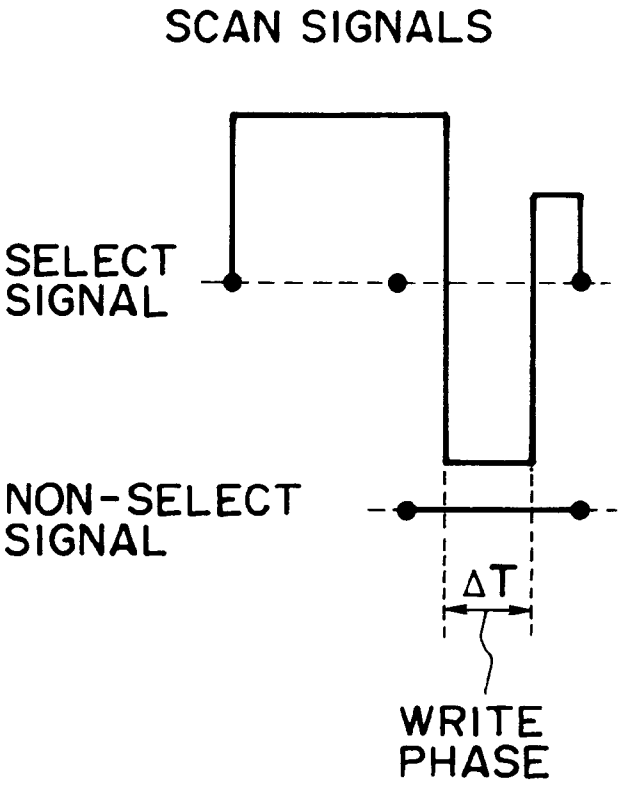

An identical liquid crystal panel was driven by applying a set of drive signals shown in FIGS. 18A and 18B otherwise in the same manner as in Example 1.

All four data signals include a data pulse synchronized with and having a pulse width ΔT identical to that of a writing pulse (ΔT) in a writing phase of a scanning selection signal. On the other hand, each of two data signals $I_{01}$ and $I_{00}$ applied in case of supplying consecutive two identical data included two auxiliary pulses for DC compensation each having pulse width (ΔT/2) and sandwiched the data pulse, and each of two data signals $I_{11}$ and $I_{10}$ applied in case of supplying consecutive two different data included two auxiliary pulses sandwiching the data pulse and each having a pulse width (ΔT/4) insufficient for DC compensation and each sandwiched between periods each of ΔT/8 of no voltage.

As a result of drive for displaying every other alternate black and white lateral stripes at a central region 2*a* as described with reference to FIG. 2, the regions 3*a* and 3*b* provided substantially identical transmittances giving a ratio of 94:96, and a high quality picture of practically no problem was obtained.

Example 6

An identical liquid crystal panel was driven by using the sets of drive signals used in Examples 1–3, respectively, but according to an interlaced scanning scheme instead of the non-interlaced scanning scheme and otherwise in the same manner as in Example 1. As a result, good picture qualities were respectively obtained while suppressing flicker depending on the degree of the interlacing and exhibiting a good crosstalk suppression effect.

The degree of the interlacing was changed so as to select every n-th scanning electrode in the range of n=2, 3, 4 and 5, whereby good picture quality was attained in any case.

Example 7

A display panel was prepared by using an anti-ferroelectric chiral smectic liquid crystal ("CS4000" available from Chisso K.K.; spontaneous polarization (Ps)=79.8 nC/cm$^2$, tilt angle=27.1 deg.).

The liquid crystal panel was a simple matrix-type panel comprising 320×240 display segments at a segment pitch of 330 μm. Each display segment comprised four pixels of R, G, B and W. The panel was driven under the conditions including a frame frequency of 15 Hz, a non-interlaced scanning scheme and drive voltages including a scanning signal voltage of 50 Vpp and a data signal voltage of 10 Vpp.

Figure 19:
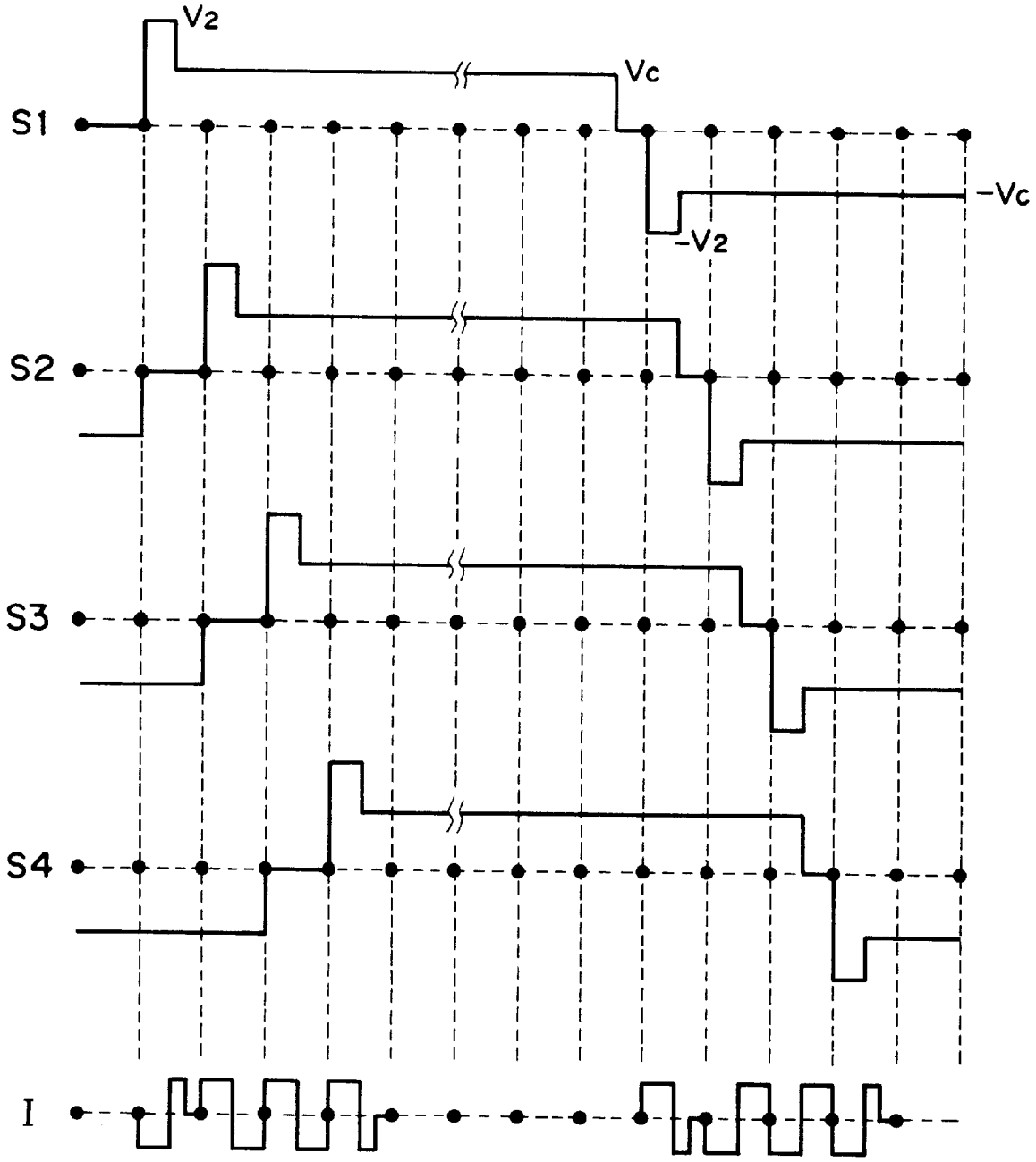
FIG. 19 is a time-serial waveform showing n exemplary portion of succession of scanning signals ($S_1$–$S_4$) and data signal (I) according to another embodiment of the invention.

The panel was driven by applying time-serial drive waveform partly as shown in FIG. 19. The scanning signals included a scanning selection signal having a selection pulse at a voltage of $V_2$ or $-V_2$ and a scanning non-selection signal having a voltage of $V_C$ or $-V_C$. The data signals were identical to those shown in FIG. 9. (For reference, an anti-ferroelectric liquid crystal is driven while effecting a polarity inversion for each frame under application of an offset voltage $V_C$, so that data signals of opposite polarities are alternately used for each field for displaying identical data.)

Various patterns including the one described with reference to FIG. 2 were displayed at a good picture quality free from crosstalk.

As described above, according to the present invention, a high-quality picture display can be performed with good suppression of crosstalk for any picture patterns including a specific pattern which has been inevitably caused a crosstalk.

What is claimed is:

1. A driving method for a liquid crystal device of the type comprising a pair of substrates having thereon a group of scanning electrodes and a group of data electrodes, and a chiral smectic liquid crystal disposed between the substrates so as to form a pixel at each intersection of the scanning electrodes and the data electrodes, said driving method comprising:

sequentially applying a scanning selection signal to the scanning electrodes, and applying data signals to the data electrodes in synchronism with the scanning selection signal, wherein the scanning selection signal comprises a writing pulse having a pulse width ΔT for determining an optical state of the chiral smectic liquid crystal in cooperation with a data signal, each data signal comprises a data pulse for determining an optical state of the chiral smectic liquid crystal in cooperation with the writing pulse, a data signal applied to a data line is determined based on data to be displayed at a particular pixel on the data line and a current scanning electrode and also on data to be displayed at a subsequent pixel on the data line and a subsequently selected scanning electrode, and at least one of said plurality of data signals includes an auxiliary pulse having a pulse width shorter than ΔT.

2. A driving method according to claim 1, wherein at least one of said plurality of data signals has a DC component within a selection period for one line of scanning electrode.

3. A driving method according to claim 1, wherein said chiral smectic liquid crystal is a ferroelectric liquid crystal.

4. A driving method according to claim 1, wherein said chiral smectic liquid crystal is an anti-ferroelectric liquid crystal.

5. A driving method according to claim 2, wherein said plurality of data signals include a first data signal including an auxiliary pulse having a pulse width shorter than ΔT and a second data signal including an auxiliary signal having a pulse width equal to ΔT, and only one of said first and second data signals has a DC component within a selection period for one line of scanning electrode.

6. A driving method according to claim 1, wherein at least one of said plurality of data signals has a zero voltage period at a first portion or a final portion of a selection period for one line of scanning electrode.

7. A driving method according to claim 1, wherein, in a case where consecutively applied two data are different from each other, a data signal corresponding to one of said two data includes a zero voltage period.

8. A driving method according to any one of claims 1–7, wherein, in a case where consecutively applied two data are identical to each other, a data signal corresponding to the identical data has a DC component of zero.

9. A driving method according to claim 7, wherein said data signal including a zero voltage period has a non-zero DC component.

10. A driving method for a liquid crystal device of the type comprising a pair of substrates having thereon a group of scanning electrodes and a group of data electrodes, and a liquid crystal disposed between the substrates so as to form a pixel at each intersection of the scanning electrodes and the data electrodes, said driving method comprising:

sequentially applying a scanning selection signal to the scanning electrodes, and applying data signals to the data electrodes in synchronism with the scanning selection signal, wherein a data signal applied to a data line includes an auxiliary pulse having a first pulse width when a current pixel and a subsequent pixel on the data line are to display different data, and a data signal applied to a data line includes an auxiliary signal having a second pulse width longer than the first pulse when a current pixel and a subsequent pixel on the data line are to display identical data.

* * * * *

UNITED STATES PATENT AND TRADEMARK OFFICE

CERTIFICATE OF CORRECTION

PATENT NO. : 6,028,579

DATED : February 22, 2000

INVENTOR(S) : AKIRA TSUBOYAMA, et al.

It is certified that error appears in the above-identified patent and that said Letters Patent is hereby corrected as shown below:

IN THE DRAWINGS

Sheet 9, FIG. 15B, "PULS" (all occurrences) should read --PULSE--.

COLUMN 1

Line 14, "case" should read --the case--;
Line 29, "description" should read --descriptions--;
Line 40, "an" should be deleted;
Line 49, "there" should read --this--; and
Line 50, ""white"between" should read --"white" between--.

COLUMN 2

Line 26, "understand" should read --understood--;
Line 38, "signal" should read --signals--;
Line 45, "a" (second occurrence)should be deleted;
Line 49, "a smaller" should read --less--; and
Line 67, "a" (both occurrences) should be deleted.

COLUMN 4

Line 13, "n" should read --an--;
Line 29, "case" should read --the case--;
Line 36, "case" should read --the case--; and
Line 37, "case" should read --the case--.

UNITED STATES PATENT AND TRADEMARK OFFICE

CERTIFICATE OF CORRECTION

PATENT NO. : 6,028,579

DATED : February 22, 2000

INVENTOR(S) : AKIRA TSUBOYAMA, et al.

It is certified that error appears in the above-identified patent and that said Letters Patent is hereby corrected as shown below:

COLUMN 7

Line 7, "a" (first occurrence) should be deleted;
Line 10, "two-side" should read --two-sided--;
Line 11, "four-side" should read --four-sided--;
Line 35, "totally" should read --a total of--;
Line 51, "drive" should read --a drive--;
Line 52, "alternate" should read --alternating--; and
Line 67, "case" should read --the case--.

COLUMN 8

Line 8, "drive" should read --a drive--; and
"alternate" should read --alternating--;
Line 23, "case" should read --the case--;
Line 26, "case" should read --the case--;
Line 31, "drive" should read --a drive--; and
"alternate" should read --alternating--;
Line 47, "case" should read --the case--;
Line 50, "case" should read --the case--; and
Line 54, "drive" should read --a drive--; and
"alternate" should read --alternating--.

UNITED STATES PATENT AND TRADEMARK OFFICE

CERTIFICATE OF CORRECTION

PATENT NO. : 6,028,579

DATED : February 22, 2000

INVENTOR(S) : AKIRA TSUBOYAMA, et al.

It is certified that error appears in the above-identified patent and that said Letters Patent is hereby corrected as shown below:

COLUMN 9

Line 3, "case" should read --the case--;
Line 5, "case" should read --the case--;
Line 11, "drive" should read --a drive--; and
"alternate" should read --alternating--; and
Line 58, "been" should be deleted; and
"a" should be deleted.

Signed and Sealed this

First Day of May, 2001

Nicholas P. Godici

*Attest:*

NICHOLAS P. GODICI

*Attesting Officer*

*Acting Director of the United States Patent and Trademark Office*